US008534258B2

(12) United States Patent
Cristoforo

(10) Patent No.: US 8,534,258 B2
(45) Date of Patent: Sep. 17, 2013

(54) GENERATOR AND CARBON MONOXIDE DETECTOR

(75) Inventor: Michael Cristoforo, Palm City, FL (US)

(73) Assignee: Daydream Believers, LLC, Palm City, FL (US)

( * ) Notice: Subject to any disclaimer, the term of this patent is extended or adjusted under 35 U.S.C. 154(b) by 467 days.

(21) Appl. No.: 12/784,297

(22) Filed: May 20, 2010

(65) Prior Publication Data

US 2011/0062725 A1 Mar. 17, 2011

Related U.S. Application Data

(60) Provisional application No. 61/243,396, filed on Sep. 17, 2009.

(51) Int. Cl.
*F02B 77/08* (2006.01)

(52) U.S. Cl.
USPC ..... 123/198 D; 204/401; 340/632

(58) Field of Classification Search
USPC ..... 123/198 D, 198 DC, 198 DB
See application file for complete search history.

(56) References Cited

U.S. PATENT DOCUMENTS 3,948,228 A * 4/1976 Luchaco ..... 123/688
4,182,960 A * 1/1980 Reuyl ..... 290/1 R
4,221,206 A * 9/1980 Haas ..... 123/198 DC
5,205,253 A * 4/1993 Shelef et al. ..... 123/198 D
5,239,980 A * 8/1993 Hilt et al. ..... 126/116 A
5,333,703 A * 8/1994 James et al. ..... 180/271
5,526,280 A * 6/1996 Consadori et al. ..... 702/24
5,576,739 A * 11/1996 Murphy ..... 340/3.4
5,691,692 A * 11/1997 Herbstritt ..... 340/438
5,764,150 A * 6/1998 Fleury et al. ..... 340/632
5,793,296 A * 8/1998 Lewkowicz ..... 340/632
5,838,243 A * 11/1998 Gallo ..... 340/632
6,040,636 A * 3/2000 DiCroce ..... 307/10.1
6,123,818 A * 9/2000 Lindsay ..... 204/400
6,200,443 B1 * 3/2001 Shen et al. ..... 204/401
6,208,256 B1 * 3/2001 Fleming et al. ..... 340/632
6,448,888 B1 * 9/2002 Horner et al. ..... 340/425.5
6,983,726 B1 * 1/2006 Luo et al. ..... 123/179.2
7,482,704 B2 * 1/2009 Priem ..... 290/1 A
2005/0100478 A1 * 5/2005 Harvey ..... 422/83
2007/0182573 A1 * 8/2007 Lin et al. ..... 340/632
2008/0182215 A1 * 7/2008 Sid ..... 431/18
2009/0127868 A1 * 5/2009 Yuri et al. ..... 290/40 R

* cited by examiner

*Primary Examiner* — Noah Kamen
(74) *Attorney, Agent, or Firm* — McHale & Slavin, P.A.

(57) ABSTRACT

A generator system and method are provided. The generator system including an internal combustion engine coupled to a generator. The internal combustion engine produces exhaust gases when operating. The system further includes a gas detector positioned in an enclosure into which exhaust gas may move. The detector is coupled to a signal transmitter that is operable to send a signal if a predetermined level of a selected gas or compound is sensed. The signal is received by an engine shut down device that is operable to shut down engine operation after the signal is received.

13 Claims, 1 Drawing Sheet

GENERATOR AND CARBON MONOXIDE DETECTOR

CROSS REFERENCE TO RELATED APPLICATION

The present application claims the benefit of priority under 35 U.S.C. §119(e) to U.S. Provisional Patent Application No. 61/243,396, filed Sep. 17, 2009, and entitled, "Generator And Carbon Monoxide Detector", the contents of which are incorporated herein by reference.

FIELD OF INVENTION

The present invention relates to a generator system useful for the generation of electricity using an internal combustion engine. The system includes a gas monitor that is useful to sense the level of toxic gas, such as carbon monoxide (CO), in an enclosure such as a bedroom; and if a predetermined level of the gas is sensed, the engine will be automatically shut down. An alarm may also be triggered.

BACKGROUND OF THE INVENTION

It is commonplace now for homeowners to own and utilize a backup generator for use when there is a power outage. Such generators are also used in areas where there is no electricity from transmission lines, such as when camping. One problem that is sometimes tragically encountered is that the exhaust gases from the engine can enter an enclosed space and cause serious harm or even death to humans and animals. This is particularly problematic when the generator set is placed close to a window or door which can be left open.

Detectors are available to sense some of these gases and provide an alarm. However, the detectors are often not maintained, malfunction or the gas is not sensed in enough time to prevent harm. Regardless of the alarm being activated, the engine continues to produce exhaust gas that can continue to enter an enclosed space and raise the concentration of toxic components. The primary toxic component is considered to be carbon monoxide, a colorless, odorless gas.

As mentioned, one of the problems with the use of generator sets is that they are often placed close to where people or animals are staying, and in warm weather, windows or doors are maintained open for ventilation. Exhaust then enters the confined space and the amount of the toxic gas increases to a non safe level. If there is no alarm or a non functioning alarm the harm can occur. Alarms can also be ignored. Even then, the gases continue to be generated which can spread to other enclosed spaces and raise the level of the exhaust gas.

There is thus a need for an improved generator system and a method of its operation.

SUMMARY OF THE INVENTION

The present invention involves the provision of a generator system that includes a generator set including an internal combustion engine coupled to a generator. A conductor is connected to the generator and is operable to conduct electricity from the generator to a place for use, e.g. a house. A gas detector is provided for use in an enclosed space adjacent the engine and is operable to sense the level of at least one component of the exhaust from the internal combustion engine to indicate the concentration of at least one toxic exhaust component such as CO. First means is operably coupled to the gas detector and is operable to generate a signal when the concentration of the monitored exhaust component exceeds a predetermined level. Second means is operably coupled to the engine to receive the first signal and when received, terminate operation of the engine.

A method of operating a generator powered by an internal combustion engine in proximity to an enclosed space is also provided. The method includes operating an internal combustion engine to power a generator in proximity to an enclosed space adapted to house one or more mammals. The operation of the engine produces exhaust gas that contains one or more toxic compounds including carbon monoxide. The air in the enclosed space is monitored for the presence and concentration of a toxic gas. A signal is generated when the concentration of the toxic gas is indicated as being above a predetermined level. The signal is transmitted to an engine shut off device and the engine is shut off.

Accordingly, it is an objective of the instant invention to provide a device for detecting carbon monoxide in an enclosed space as the result of the exhaust of an electrical generator and stop the operation of the electrical generator.

It is a further objective of the instant invention to provide a detector located in a space being monitored for carbon monoxide and having the detector sound an alarm in the space and stop the operation of the electrical generator.

It is yet another objective of the instant invention to provide a wireless connection between the detector and the electrical generator.

It is a still further objective of the invention to provide a test feature on the detector to determine if the detector is operable.

Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
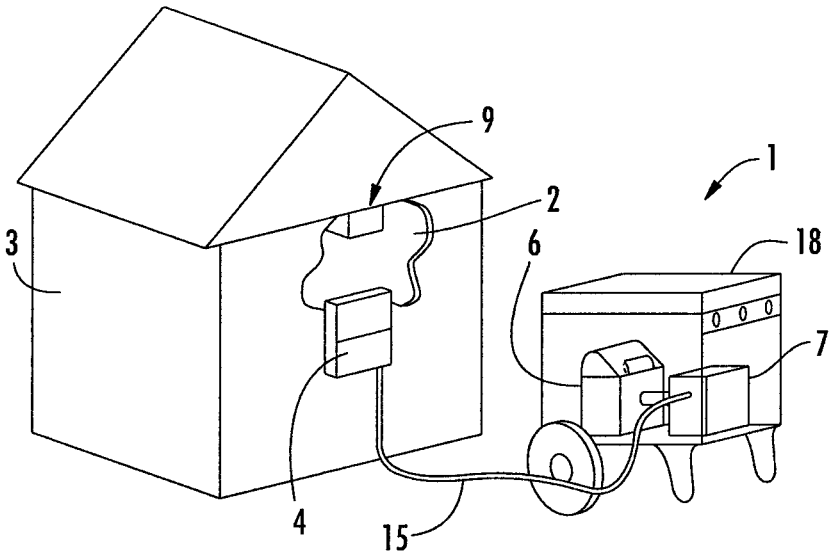
FIG. 1 is a schematic illustration of a generator system usable adjacent an enclosed space habitable by one or more mammals and FIG. 2 is a schematic illustration of the generator system of FIG. 1.
Figure 2:
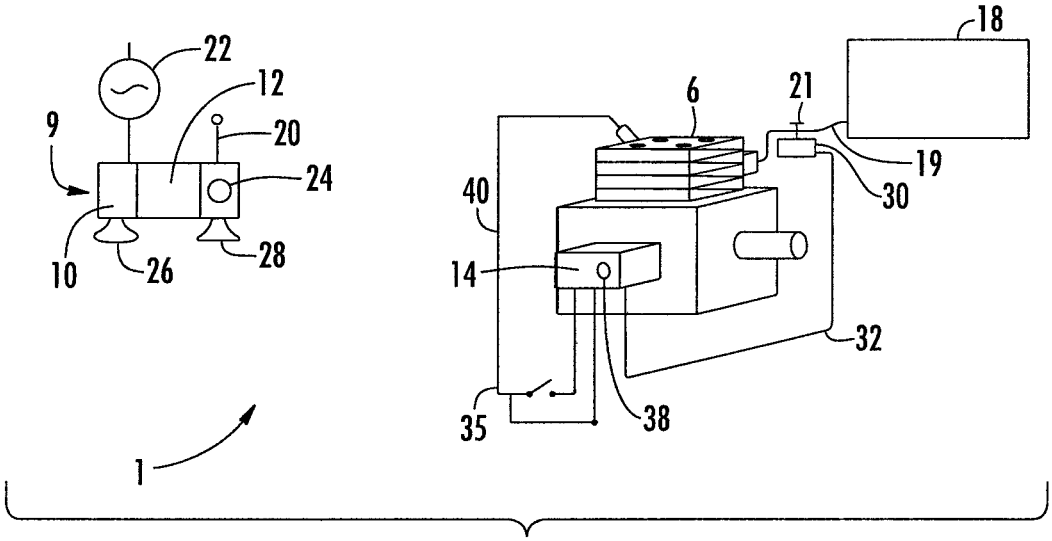

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiments illustrated.

Like numbers used throughout this application represent like or similar parts and/or construction.

The reference numeral 1 designates generally a generator system usable adjacent an enclosed space 2 that is operable to automatically shut down if one or more exhaust gas components reach a predetermined level or concentration in the space 2. The enclosed space 2 may be a room in a house, camper, tent, barn, shop, garage or the like. As shown, the space 2 is part of an enclosure 3 such as a residence having a window 4 or the like forming a communication path between the space 2 and the locus of a generator set including an engine 6 powering a generator 7. The generator system 1 includes a detector apparatus 9 including a detector 10 operable to sense a component of the exhaust from the engine 6. The detector 10 is operably associated with means 12 that is operable to generate a signal if a predetermined level of an exhaust compound is sensed. Means 14 is provided to receive the signal and terminate operation of the engine 6.

The space 2 may be any suitable space that can be occupied by one or more mammals such as people, pets and livestock. Generator sets are often operated in proximity to such spaces. The space 2 may be part of a house, apartment, townhouse, RV, camper, tent, barn, garage and the like. Such spaces, if not properly sealed from ingress of gas, can receive exhaust gas from the engine 6 during its operation. Carbon monoxide is a component of exhaust gas and is toxic when concentrations are too high. If an internal combustion engine is operated next to an enclosure and there is a means for ingress of exhaust gas to a space 2, there is a risk that the exhaust gas will enter the space presenting the potential of injury or death to a mammal.

The generator system 1 includes an engine 6 coupled to a generator 7 to power its operation to generate electricity as needed. This is usually done during a power outage or in areas where electricity is not available through transmission lines, such as camp sites. Typically the engine 6 and generator 7 are placed in close proximity to an enclosure 3 and electricity is carried from the generator 7 by a conductor 15 such as an extension cord. Some generators are hard wired to the electrical system of an enclosure 3 and the invention is applicable to those systems as well. Some generators are of a permanent installation type and the present invention is applicable to them as well.

The engine 6 may be any suitable engine that uses combusted material as an energy source. The engine 6 is of an internal combustion type and can be a spark ignition engine, a compression ignition engine such as a diesel engine or a turbine. However, the most frequently used engines are of a piston type utilizing burnable fuel from a fuel source 18 such as a fuel tank, a natural gas line, propane tank or the like. The fuel source 18 is connected to the carburetion system such as a carburetor or fuel injector via a fuel line 19. The fuel line 19 is preferably provided with a fuel shut off valve 21.

Generally, engines can be shut off in one of two basic ways, the ignition system is either deprived of input electrical energy or the generated spark is prevented from reaching the spark plug as by grounding. The other way, usually used in compression ignition engines is to deprive the cylinders of fuel. This can be accomplished by closing a fuel valve 19 or for engines using electronic fuel injection, terminating electrical energy flow to the injector system. The present invention can utilize any means to terminate operation of the engine as more fully described below.

The generator system 1 includes the detector system 9 having a detector 10 which is operable to monitor and sense the level of a selected chemical found in the exhaust gas. When the concentration reaches a predetermined level, the detector system 9 provides a signal from transmitter 12 to the receiver system 14 to terminate engine operation in an automatic manner. The transmitter 12 and receiver system 14 may be coupled for signal transfer in any suitable manner which may be wireless or wired. Preferably a wireless coupling is utilized and may be by radio frequency, light or sound transmitted through the air. The detector 10 may be any suitable detector and is preferably one capable of detecting and quantifying the amount of CO in the adjacent air. The detector 10 is preferably positioned in the space 2 adjacent a location where exhaust can enter the space 2. More than one detector system 9 or detector 10 can be used with each being positioned at a desired location. The detector system 9 may be permanently and/or temporarily installed in a space 2. However, the detection of any exhaust component that can directly or indirectly indicate the level of CO may be utilized. CO is a principal toxic component of the engine exhaust and can be easily monitored and quantified directly. Carbon dioxide ($CO_2$) is another harmful component of engine exhaust gases. It is preferred that CO be monitored for directly. The detector 10 provides a signal indicating a too high level of the monitored exhaust component or compound, CO and/or $CO_2$, to the transmitter 12 to provide a signal to the receiver system 14. The means 12 may be an RF transmitter and provide the signal by wire or wirelessly and preferably provides an RF signal wirelessly from an antenna 20 to the receiver system 14. The detector 10 and transmitter 12 may be powered by any suitable power source such as an AC power source 22 and/or battery (not shown). A test system may also be provided for the detector system 9. Upon pressing an activation button 24 a test procedure is initiated and, if the unit is functioning properly, a light 26 and/or sound emitter 28 such as a speaker or chirper may be energized to indicate operability.

The receiver system 14 is operably associated with the transmitter 12 to receive the signal for engine shut down and be operable to effect engine shut down. The receiver system 14 preferably includes an RF receiver that is compatible with the transmitter 12 to receive and process its signal. The receiver system 14 can provide a signal to a valve actuator 30 such as a solenoid as by a conductor 32. The receiver system 14 provides a signal that will effect closing of the valve 21 which will terminate fuel flow and stop operation of the engine. The receiver system 14 could also de-energize electronic fuel injectors so that the engine is deprived of fuel to stop engine operation. The receiver system 14, when used with a spark ignition engine, can prevent flow of electricity to the spark plug which will terminate operation of the engine 6. This can be done by shunting spark energy from the spark plug to ground via a conductor 35 or by de-energizing the ignition system. A reset feature 38 can be provided so the engine can be restarted as desired.

The present invention is better understood by a description of its operation. An internal combustion engine 6 is operated to power a generator 7 in proximity to an enclosed space 2. The space 2 is adapted to house one or more mammals. The space 2 may be part of a house, shed, garage, barn, tent, RV or the like. During operation, the engine 6 produces exhaust gas. The space 2 is monitored for air quality for the presence and concentration of a toxic gas. The toxic gas, e.g., CO, concentration may be monitored directly or indirectly using another sensed compound that is indicative of the level of the toxic gas. A signal is generated when the concentration of the toxic gas is indicated as being above a predetermined level. The signal is transmitted to the receiver system 14 which is operable to effect engine shut down. In a preferred embodiment, the shutoff device may be coupled to an existing engine shutoff switch circuit 40 permitting easy retrofitting of existing generator sets.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A generator system comprising:

an internal combustion engine coupled to a generator, said internal combustion engine positioned outside the confines of a dwelling;

a conductor connected to the generator and operable to conduct electricity from the generator; and a detector operable to sense the level of at least one component of exhaust from an internal combustion engine to indicate the concentration of at least one of carbon monoxide and carbon dioxide in an enclosed space, said detector positioned within the confines of said dwelling;

first means operably coupled to the detector and operable to generate a first signal when the concentration of at least one of carbon monoxide and carbon dioxide exceeds a predetermined level; and second means operably coupled to the engine to receive the first signal and when received, terminate operation of the engine; said first and second means being wirelessly coupled, whereby said first means can wirelessly communicate with said second means.

2. The generator system of claim 1 wherein the second means includes a switch operable to interrupt operation of an engine ignition system.

3. The generator system of claim 1 wherein the second means includes a valve operable to terminate fuel flow to an engine cylinder.

4. The generator system of claim 1 wherein the second means includes means to terminate fuel flow to an engine cylinder.

5. The generator system of claim 1 wherein the first means including an RF transmitter and the second means including an RF receiver.

6. The generator system of claim 5 wherein the engine including a sparkplug ignition system and the second means including a switch operable to selectively prevent sparking of a sparkplug.

7. The generator system of claim 5 wherein the engine being a diesel engine and the second means including means operable to prevent flow of fuel to an engine cylinder.

8. The generator system of claim 1 including a test system coupled to the detector and operable to test operability of the detector.

9. The generator system of claim 8 wherein the test system including a light that will be on if a test of the detector operability is successful.

10. The generator system of claim 8 wherein the test system including a sound generator that will emit a sound if a test of the detector operability is successful.

11. A method of operating a generator powered by an internal combustion engine in proximity to an enclosed space, the method including:

operating an internal combustion engine to power a generator outside of but in proximity to an enclosed space adapted to house one or more mammals, said engine producing exhaust gas during operation;

monitoring the air in the enclosed space for the presence and concentration of a toxic gas;

generating a wireless signal when the concentration of the toxic gas is indicated as being above a predetermined level;

transmitting said wireless signal to an engine shut off device; and said engine shut off device being secured to said internal combustion engine and being constructed and arranged for shutting off the engine in response to receiving said wireless signal.

12. The method of claim 11 wherein the toxic gas being monitored for including CO.

13. The method of claim 12 wherein the toxic gas being monitored for being monitored directly.

* * * * *